United States Patent [19]

Mott

[11] 4,009,646

[45] Mar. 1, 1977

[54] METHOD OF AND APPARATUS FOR RAPIDLY LINING CONTAINERS

[76] Inventor: William E. Mott, 215 Wilson Downing Road, Lexington, Ky. 40507

[22] Filed: July 2, 1975

[21] Appl. No.: 592,612

[52] U.S. Cl. ..... 93/36.01; 93/55

[51] Int. Cl.[2] ..... B31B 7/02

[58] Field of Search ..... 93/36.01, 36.6, 37 R, 93/37 EC, 54 R, 55, 39 R, 36 R, 36 M; 229/14 BE, 14 H, 14 C, 14 R; 53/175, 67, 71, 70; 29/208 B

[56] References Cited

UNITED STATES PATENTS

| | | | |
|---|---|---|---|
| 2,132,956 | 10/1938 | Kieckhefer | 93/36.01 |
| 2,704,013 | 3/1955 | Reynolds et al. | 93/36.01 |
| 2,871,773 | 2/1959 | Verrinder | 93/36.01 |
| 3,134,308 | 5/1964 | Ali-Oglu | 93/36.01 X |
| 3,772,121 | 11/1973 | Peltier et al. | 93/36.01 X |
| 3,780,627 | 12/1973 | Roda | 93/37 R |
| 3,803,993 | 4/1974 | Graham | 93/37 R X |

*Primary Examiner*—James F. Coan
*Attorney, Agent, or Firm*—William E. Sherwood

[57] ABSTRACT

Apparatus for rapidly lining a container with a box-like array of discrete lining panels includes a panel-grasping mechanism maintaining a vacuum grip on the panels until the array is deposited in the container. A method for safely and rapidly operating the apparatus automatically in accordance with a prescribed program of interrelated steps is disclosed. The method provides for immediate interruption of the apparatus movements in event of a malfunction and after correction of the malfunction for resumption of apparatus movement from the point in the cycle at which the interruption occurred.

20 Claims, 19 Drawing Figures

METHOD OF AND APPARATUS FOR RAPIDLY LINING CONTAINERS

BACKGROUND OF THE INVENTION

At large commercial establishments for packing and chilling fruit, vegetables or the like preparatory to shipping the same, it is customary to line the cardboard shipping container with panels of a heat insulating material, then fill the lined container, chill the produce, and thereafter insert the top panel of lining over the chilled produce followed by closing the completely lined container in readiness for storage or shipment. The lining generally comprises discrete panels of an efficiently insulating light-weight material such as styrofoam which must be arranged manually within an empty open-top container at the lining station. This step of manual lining not only requires numerous workers when the establishment has a large through-put of produce, but also entails the use of more floor space and slows the operation of auxiliary equipment such as fast moving conveyors, panel and container supplying means or the like, to the rate at which the manual workers can perform their lining tasks. In other words, the lining phase of the entire operation constitutes a 'bottle-neck', and which it is a purpose of the present invention to overcome.

SUMMARY

The invention is embodied in an improved method for automatically, rapidly and safely lining an open-top container with an array of two side, two end and one bottom panels held by a panel-grasping mechanism whose movements are carried out in accordance with a prescribed program of interrelated steps. The apparatus includes not only the panel-grasping mechanism, but also coordinated equipment for dispensing the panels, for conveying of panels and containers, and for controlling the sequence of the steps of operation.

Among the objects of the invention are the provision of a method for automatically lining a container at a high rate of output; the provision of a method which can be carried out safely by automatically interrupting operation upon occurence of a malfunction and by requiring manual intervention in order to restart operation; the provision of a method in which restarting of an interrupted cycle of operation begins at the point in the cycle at which such interruption occurred; the provision of a lining apparatus having a panel-grasping mechanism adapted to assemble a box-like lining array of five discrete panels, the provision of a lining apparatus having means for dispensing side and end panels from racks to a panel-grasping mechanism; the provision of a lining apparatus having means for rapidly moving a bottom panel to a lining station beneath a panel-grasping mechanism; and the provision of a lining apparatus having means for rapidly moving an unlined container to a lining station beneath a panel-grasping mechanism.

These and other objects and advantages will become more apparent as the description proceeds and when considered in conjunction with the accompanying drawings in which FIG. 1 is a veiw indicating the relationship of the array of discrete lining panels and the container prior to insertion of the array into the container.

FIG. 6 is an end view to an enlarged scale of one of the horizontally movable panel-positioning units forming a portion of the panel-grasping mechanism.

Figure 1:
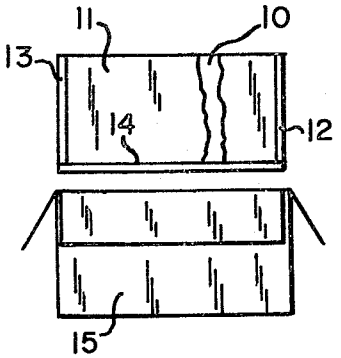

As indicated in FIG. 1, the method of the invention embodies the step of assembling an array of flat discrete side panels 10, 11; end panels 12, 13; and a bottom panel 14 at an elevated position above an open-top container 15 and thereafter inserting the array as a unit into that container rapidly and automatically. The apparatus by means of which the method is practiced preferably first spaces and holds the side panels in vertical planes, then brings the end panels into abutting contact with the so-held side panels, then brings the bottom panel into abutting contact with the so-held side and end panels, then while grasping the array of discrete panels inserts the same into the container and after releasing its hold upon the array returns to its normal position in readiness for the next cycle of operation.

Figure 2:
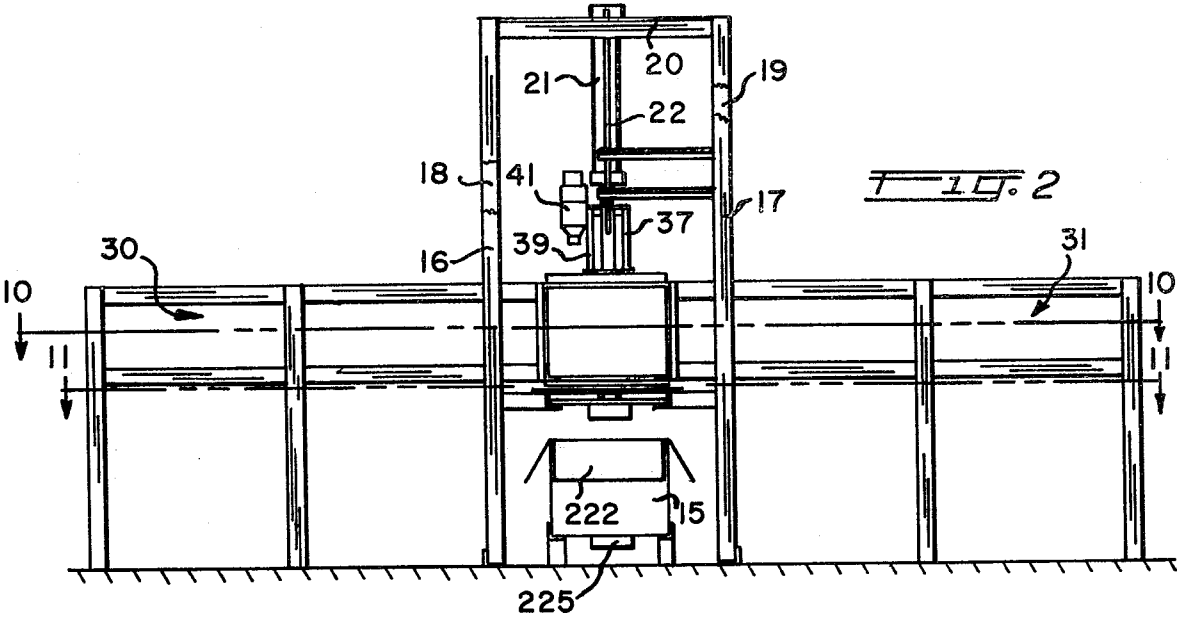
FIG. 2 is an end view of the stationary portion of the apparatus at the lining station and showing panel storage racks.
Figure 3:
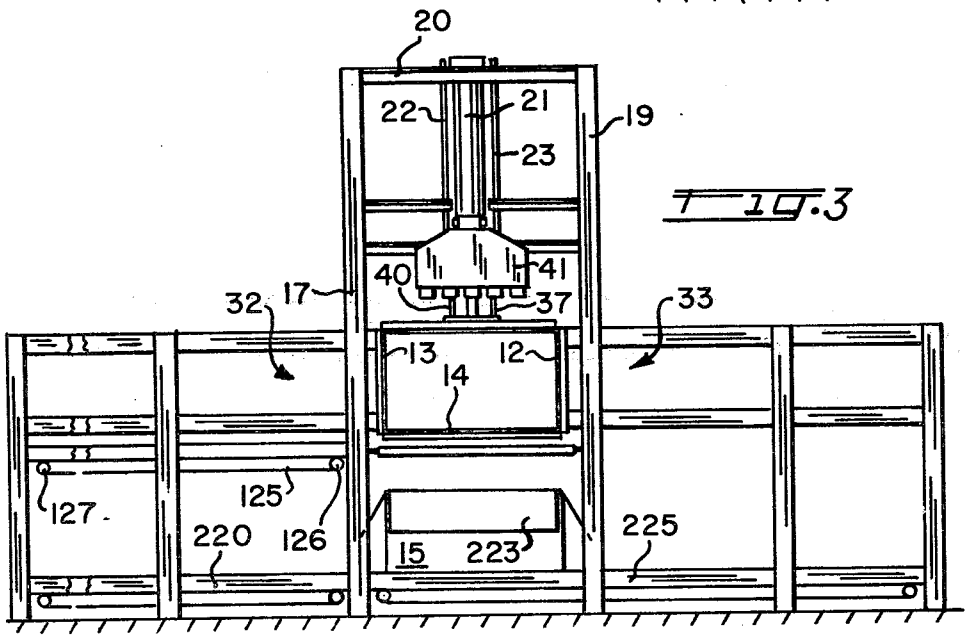
FIG. 3 is a side view of the apparatus of FIG. 2.
Figure 10:
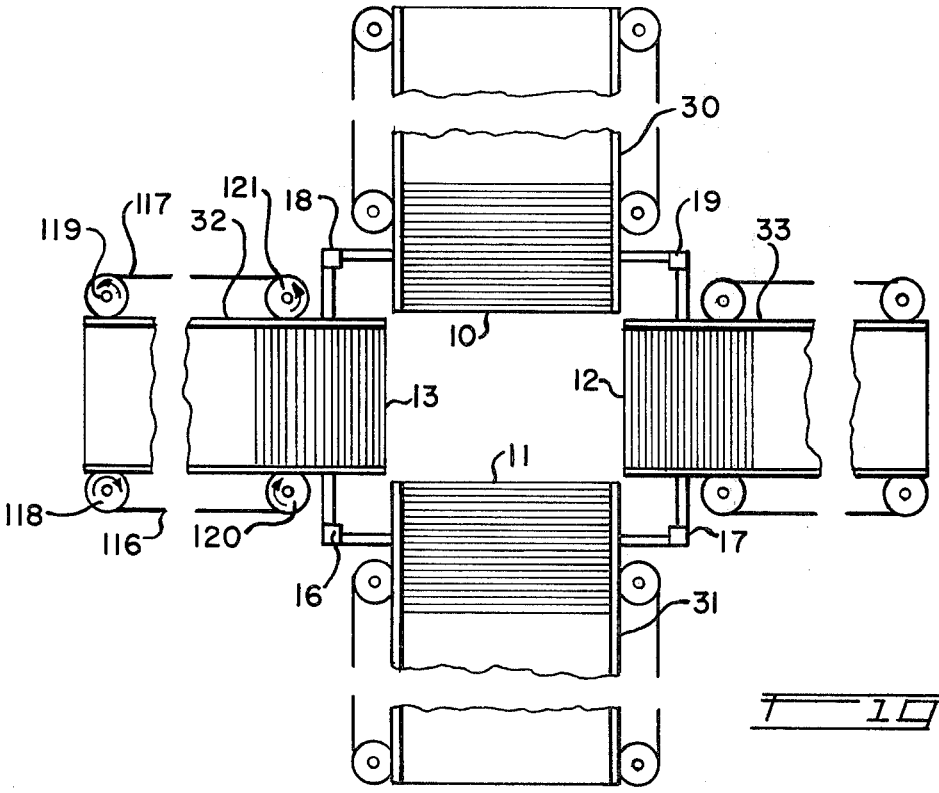
FIG. 10 is a plan view indicating the arrangement for supplying end and side panels to the shutters for dispensing to the panel-grasping mechanism.

Referring now to FIGS. 2 and 3, the stationary portion of the apparatus includes a lining station defined by a rigid framework of spaced uprights 16, 17, 18 and 19 joined at their upper ends by suitable cross braces 20 upon which a motor 21, for example a double-acting air motor, is supported. Also mounted on the framework is a pair of spaced, rigid downwardly extending rods 22, 23 serving to guide movement of the panel-grasping mechanism shown in FIG. 5. A group of four elevated stationary racks indicated generally at 30, 31, 32 and 33, each preferably comprising four right-angle stringers serving to confine the respective corners of the respective side and end panels which it stores, have their confronting ends terminating within the space bounded by the uprights at the lining station, as best seen in FIG. 10, and located at an elevation which is above the container to be lined.

Figure 4:
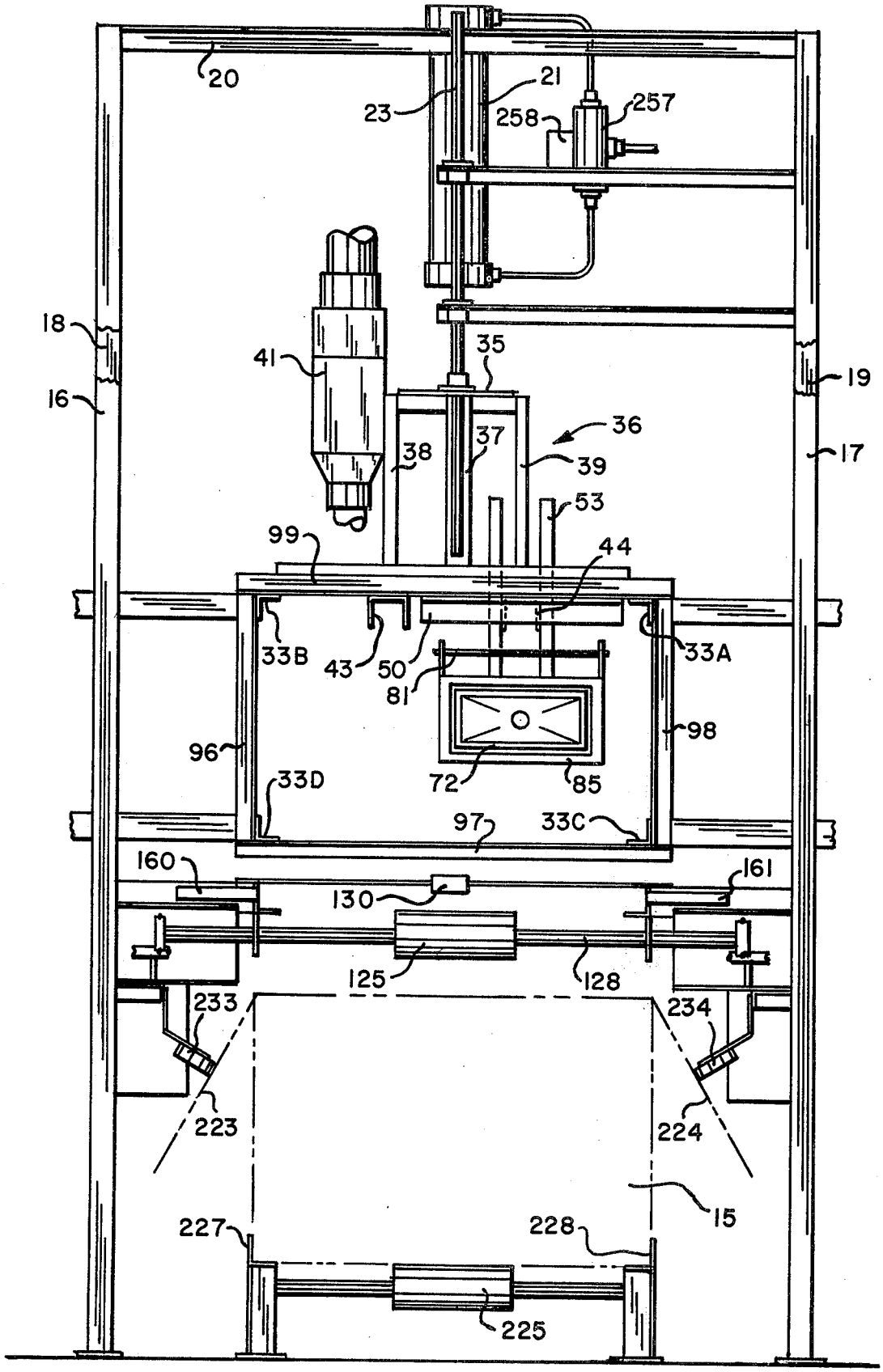
FIG. 4 is an end view to a larger scale showing the mounting of the vertically reciprocable panel-grasping mechanism, and the bottom panel inserting means, upon the stationary framework.

As shown, for example, in FIG. 4, the four stringers 33A, 33B, 33C and 33D of rack 33 provide for the confinement of the four corners of an end panel 12 which is to be fed to the panel-grasping mechanism now to be described.

PANEL-GRASPING MECHANISM

Figure 5:
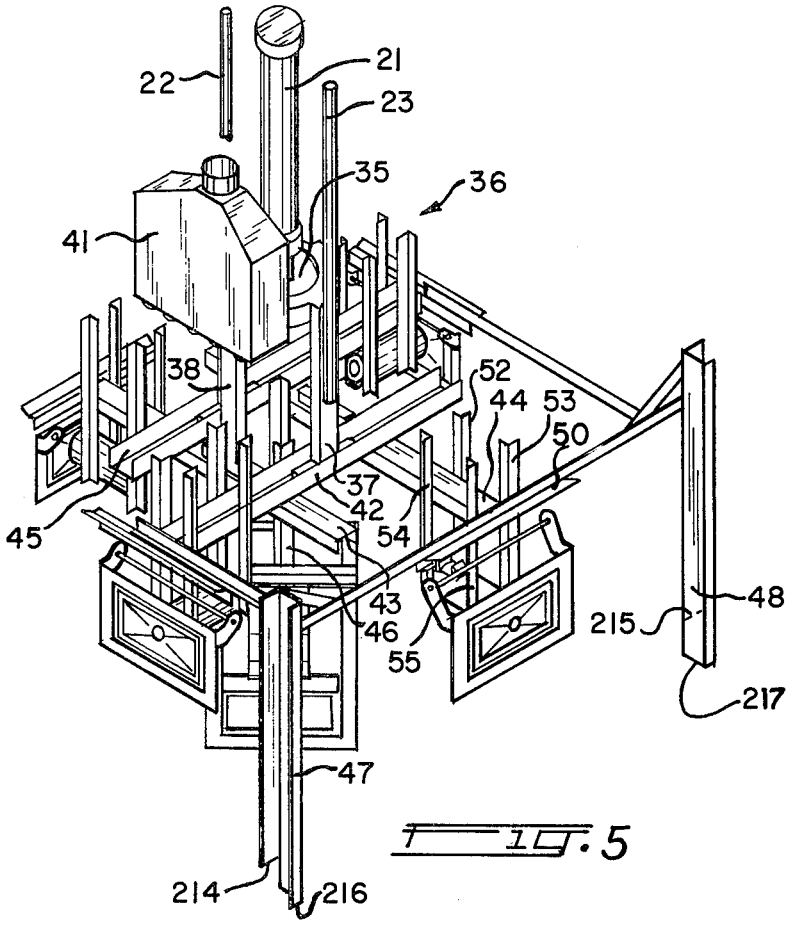
FIG. 5 is a perspective view of the panel-grasping mechanism showing the mounting of the five grasper units.

Attached to the lower end of the piston rod of motor 21 is a suspension plate 35 to which is rigidly affixed a bracket indicated generally at 36 and having four symmetrically spaced downwardly extending legs 37, 38, 39 and 40. Laterally of the bracket and affixed thereto is a housing 41 forming a vacuum plenum chamber. At their lower ends the bracket legs are rigidly affixed to horizontally extending beams 42, 43, 44 and 45 respectively and which conveniently may be of channel shape with one pair of beams having their sides directed upwardly and the other pair with sides directed downwardly and with the beams being joined at their areas of intersection for greater rigidity as seen in FIG. 5. Centrally of the bracket a depending beam 46 is provided for mounting of the panel grasper unit which is to engage the bottom panel of the liner array, as will later be described. Also carried by the bracket are rigid downwardly extending latch-tripping legs 47, 48 serving to release the pivotal shelves on which the bottom member is normally positioned prior to movement of the panel-grasping mechanism into the container being lined, and as to be explained with respect to FIGS. 11 to 13.

Figure 7:
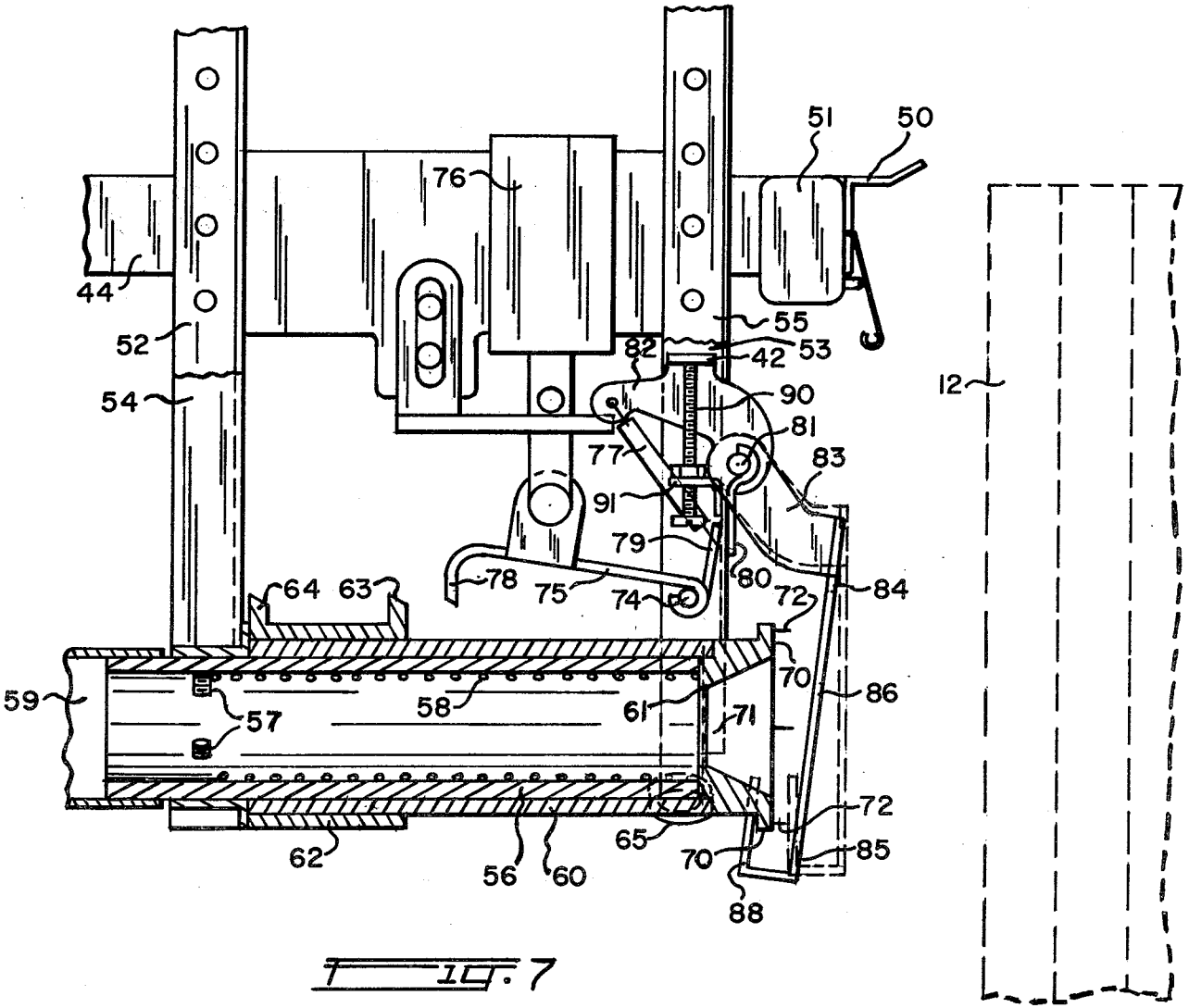
FIG. 7 is a partial sectional view taken on line 7—7 of FIG. 6.

Passing now to FIGS. 6 and 7, a typical panel grasper unit of the panel-grasping mechanism is shown in detail and indicates the manner in which end panel 12 is moved to and grasped in proper position during the forming of the array. A panel-indexing angular abutment 50 extending transversely at the end of beam 44 serves to limit the inward movement of end panel 12 as well as to limit the upward movement thereof when the bottom panel is drawn into contact with that end panel. A microswitch 51 also is mounted upon abutment 50 and is closed when panel 12 is properly indexed. Although not shown on the structural drawings, similar microswitches 51A for the end panel 13 and 51B and 51C for the side panels 10 and 11 are provided on the panel-graspers for those companion panels and a microswitch 51D for the bottom panel-grasper also is employed. Vertically adjustable supports 52, 53, 54 and 55, which conviently may be of right angle section, are affixed to the side walls of channel beam 44 as indicated in FIG. 5 and at their lower ends support therebetween a fixed cylindrical horizontal tube 56 provided with a series of short inwardly extending screws 57 forming an abutment for a compression spring 58 disposed within the tube. Attached to the inner end of the tube is a vacuum conduit 59 leading to the plenum chamber 41.

Slidably mounted upon tube 56 with a key and slot arrangement to prevent rotation is a cylindrical sleeve 60 having an inwardly directed lip 61 against which spring 58 abuts. Adjacent its rearward end the sleeve has a locking band 62 provided with a first beveled ear 63 spaced axially from a second beveled ear 64. To provide support for the sleeves during its movement a pair of rollers 65, 66 mounted upon outwardly splayed portions of the respective edges 67, 68 of supports 53 and 55 bear against the tubular surface of that sleeve. At its hollow outer end the sleeve preferably is provided with a flat rectangular rim 70 bounding a much larger area than the central opening 71 leading into tube 56, and serving to insure a tight grasp upon panel 12 when the sleeve is moved into contact with that panel and while vacuum is being supplied. Since the lining panels are of soft material, the rim of the sleeve preferably is provided with sharp pins 72 which engage the panels and hold it against slippage as it is released from its storage rack and while it is being assembled into the box-like array with the other panels.

Disposed above the sleeve and mounted on supports 53, 55 is a horizontal rod 74 upon which a latch 75 is arranged for pivotal movement jointly under the influence of a solenoid 76 adjustably mounted upon beam 44 and under the influence of a tension spring 77. At one end the latch has a beveled claw 78 engageable with the ears 63, 64 of the sleeve and at its other end has an integral projection 79 to which one end of spring 77 is attached in order normally to pull the claw downwardly.

Rotatably mounted upon the forward faces of the supports 53 and 55 by means of suitable brackets, one of which is shown at 80 (FIG. 7) is an elongated rod 81 and rigidly attached too this rod is a first arm 82 to which the other end of spring 77 is attached, and a second arm 83 supporting an apertured rectangular vane adapted to contact the surface of panel 12. This vane (FIG. 6) is provided with laterally extending surfaces 84, 85 and vertically extending surfaces 86, 87 and with an aperture through which the entire rim 70 of the sleeve may be extended. At its lower corners the vane has rearwardly extending offset tabs 88, 89 which are engaged by the rim 70 of that sleeve during its rearward movement thus serving to disengage the vane from contact with the lining panel after the array of panels has been deposited in the container. As will later appear, the function of the vane is to hold panel 12 in a true vertical plane while the panel is being engaged by the rim of the sleeve. Moreover, adjustment of the vane may be accomodated by a set screw 90 mounted in a bracket 91 on the supports 55 and bearing against a lateral extension 92 of the first arm 82.

Having thus described a typical panel-grasper unit for the end panel 12 of the array, it will be understood that the grasper units for the other three vertical panels are of similar construction and that the bottom panel-grasper unit is of a generally similar construction except for the omission of the vane which is not needed to hold such bottom panel against displacement.

Figure 19:
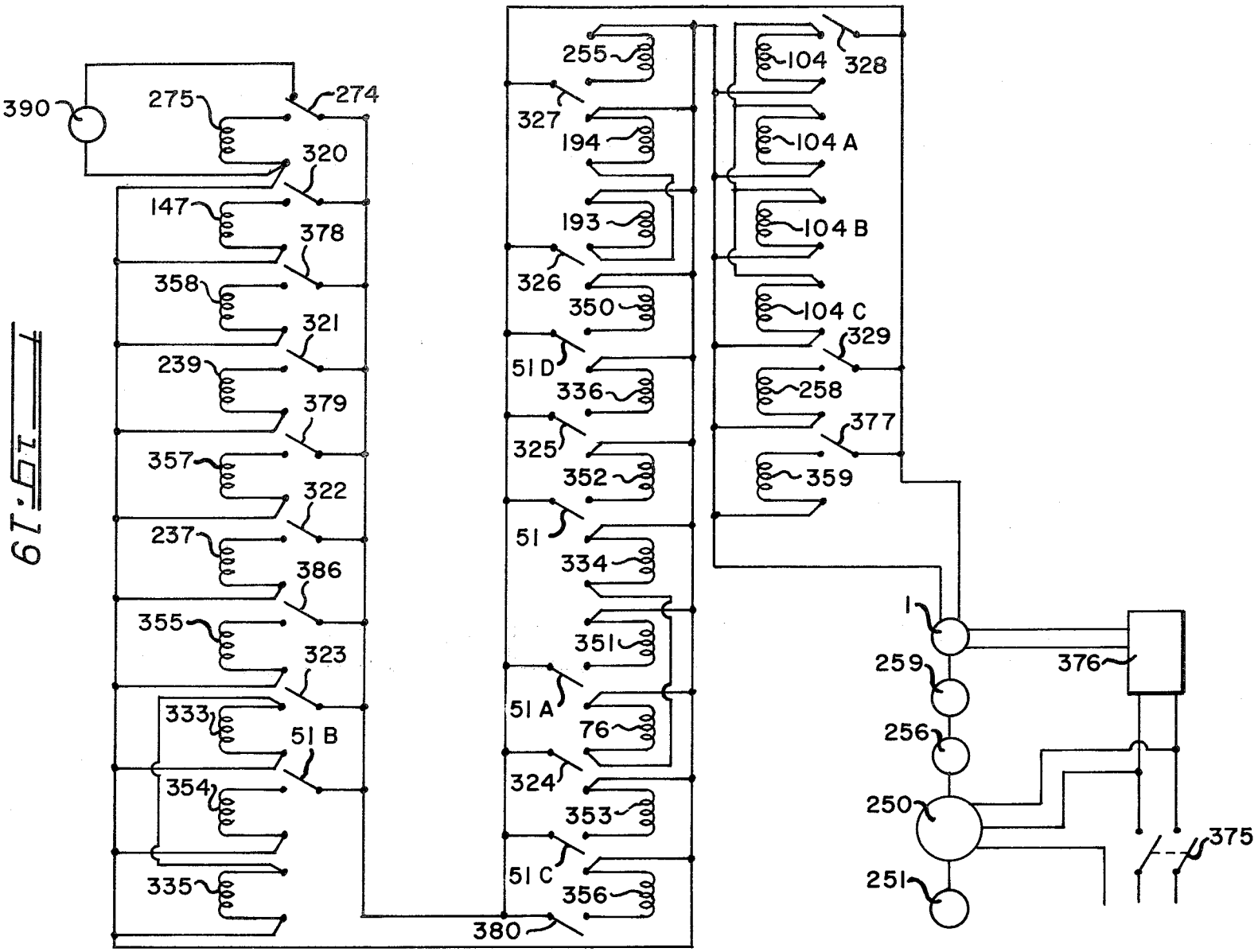
FIG. 19 is a diagrammatic view of the electrical control circuit.

As will later appear by reference to FIG. 19, the mechanism for assembling the two side panels embodies solenoids 333 and 335 in series and controlled by switch 323; for the two end panels the solenoids 76 and 334 in series and controlled by switch 324; and for the single bottom panel the solenoid 336 controlled by switch 325.

SIDE AND END PANEL SUPPLYING AND DISPENSING MEANS

Figure 9:
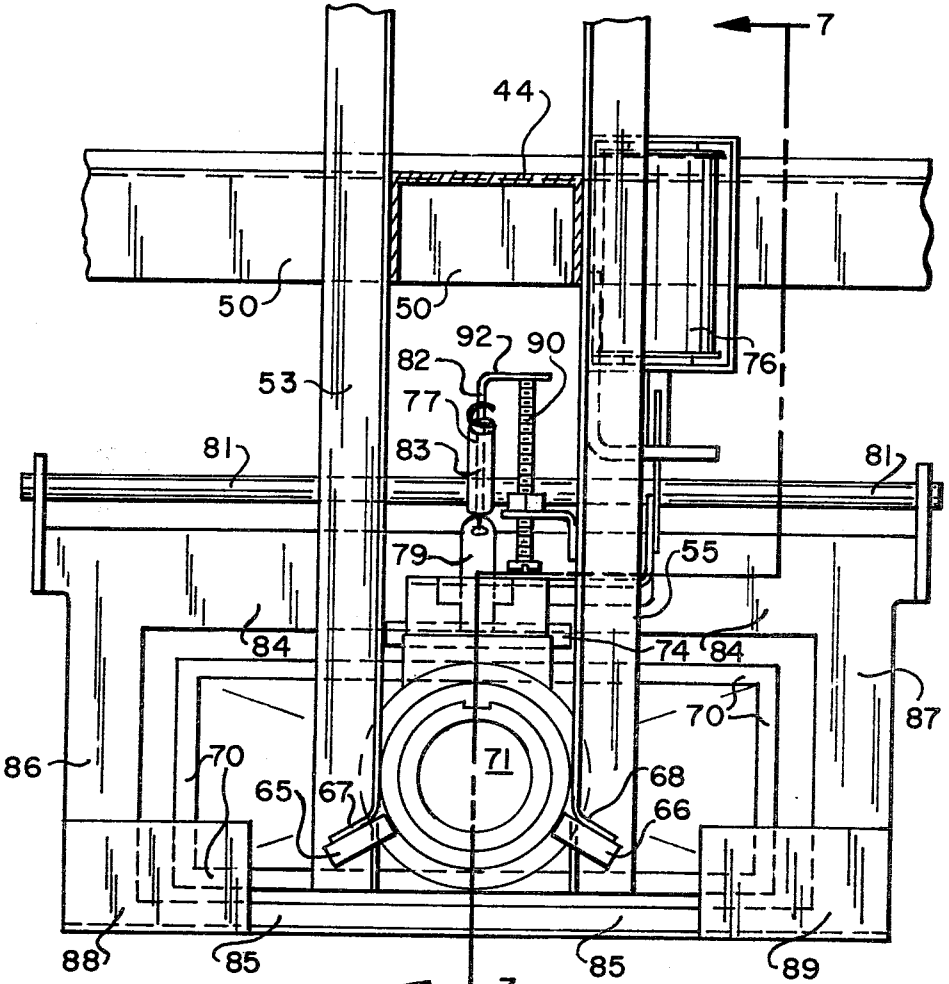
FIG. 9 is a perspective view to a larger scale of one of the latches for the shutter of FIG. 8.
Figure 8:
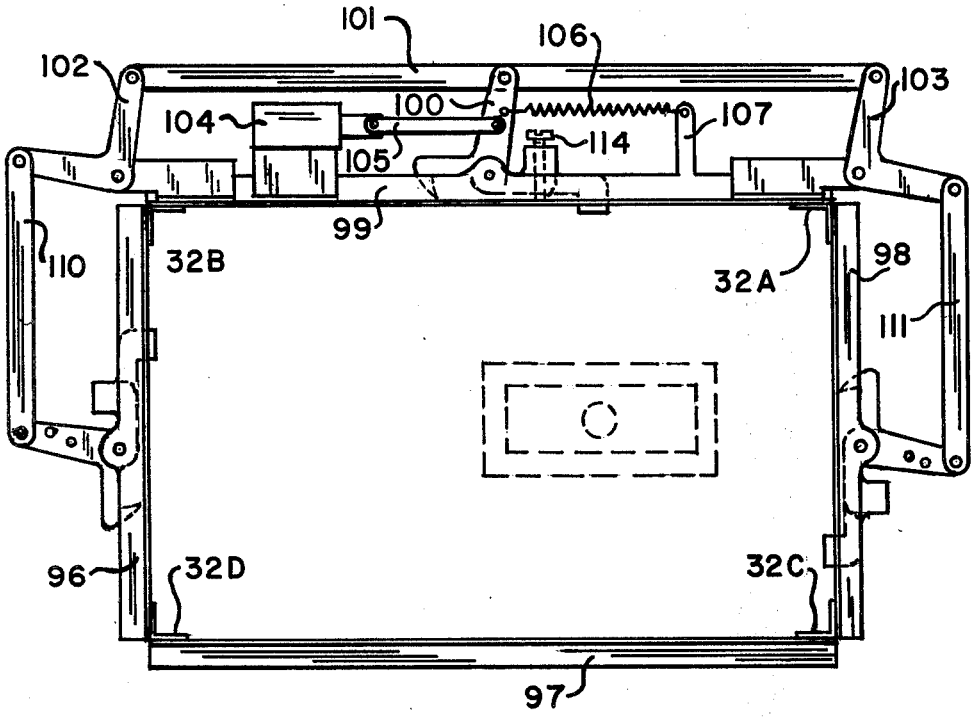
FIG. 8 is an elevation view of a panel-dispensing shutter positioned at the end of a corresponding rack.
Figure 9:
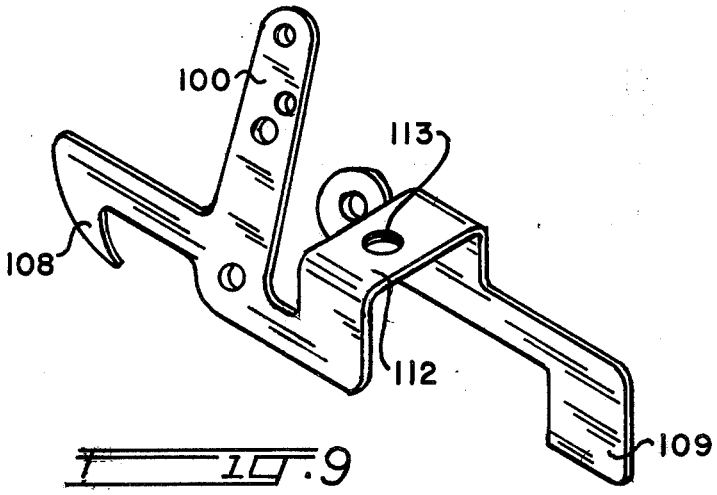

As will be evident, operation of the above-described panel-grasping mechanism requires the sequential removal of the panels from their storage racks and as best seen in FIGS. 8 and 9 each of these racks is equipped at its innermost end with a panel-dispensing shutter. Rack 32 for end panels 13, for example, includes angular frame members 96, 97, 98 and 99 bounding the open ends of stringers 32A to 32D and providing a support for the shutter and for a group of interlocked side and top latches which regulate the dispensing of the panels to the panel-grasping mechanism. The top latch includes a rocker arm 100 pivotally mounted on frame member 99 and pivotally attached at its upper end to a transverse rod 101 having bell cranks 102, 103 at its ends. A solenoid 104 with a rod 105 connected to arm 100 actuates the panel dispensing means and by means of a spring 106, connected between a stationary abutment 107 and arm 100, the assembly normally occupies a position holding the panels 13 against advancement. The latch (FIG. 9) includes a hook-like portion 108 on one extremity adapted to engage in the outer edge of the next following panel in the rack, and has an inwardly offset face 109 adapted to abut against the leading face of the panel first to be dispensed. Normally the face 109 is offset approximately one and one-half times the thickness of a panel from the plane of the hook portion and the face 109 extends within the confines of the storage rack. Similar side latches and a similar end panel latch for the other end panel and controlled by solenoids 104A, 104B and 104C in series with solenoid 104 are disposed at the ends of the racks and then arms 100 are connected by rods 110 and 111 to the respective bell cranks 102 and 103. Therefore, upon actuation of those solenoids all latches act to retract their faces 109 allowing the appropriate panel-positioning unit of the above-described panel-grasping mechanism to pull the nearest panel from its ready position on the rack. At the same time the rocking motion of the latches impales the next following panel and holds it until the solenoids are deenergized. After such deenergization spring 106 restores the faces 109 into obstructing position for that following panel which is then advanced by the conveyor now to be described. Moreover, a bridging section 112 on the top latch is provided with a threaded aperture 113 through which an adjusting screw 114 extends. The lower end of that screw contacts the frame member 99 when the latch is at rest and the extent of the rocking movement of the latches can thus be governed by the setting of that screw.

Referring now to FIG. 10, a suitable arrangement for supplying side and end panels, as needed, to the shutter dispensing means at the ends of the racks may comprise four pairs of conventional endless belts 116 and 117 passing over driven pulleys 118, 119 and over idler pulleys 120, 121 and associated with each of the respective racks. The belts which are constantly in frictional engagement with the vertical side edges of the panels advance the stack of panels until the above-described latches of the shutters prevent further movement after which the belts slide along the stack of panels. As will be understood, the panels are loaded at the distal ends of the racks and the drive means (not shown) for the belt conveyors is controlled independently from the electrical circuitry of the remainder of the apparatus.

BOTTOM PANEL POSITIONING AND RELEASING MEANS

Figure 11:
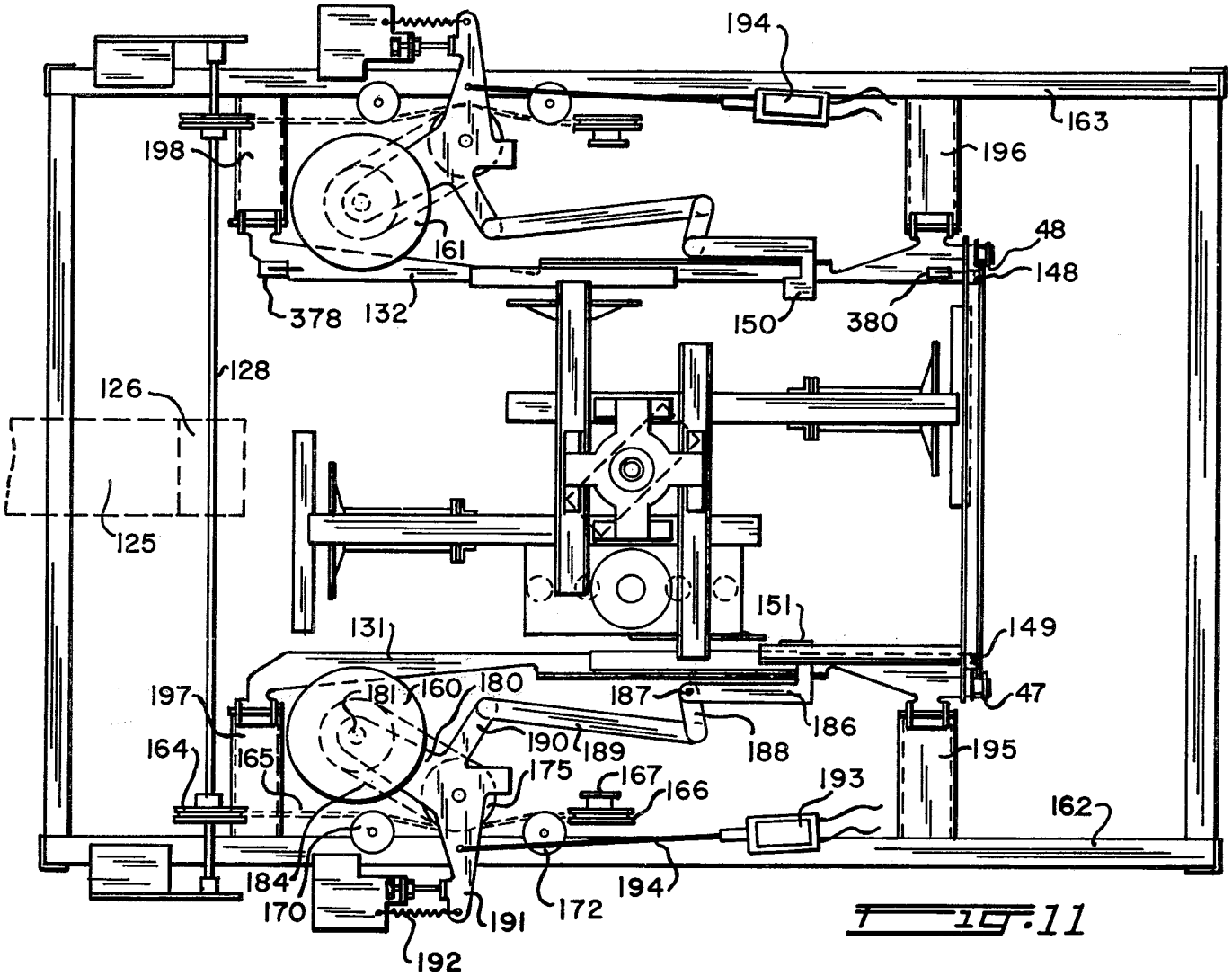
FIG. 11 is a plan view, with portions omitted, showing the bottom panel positioning and releasing means.
Figure 12:
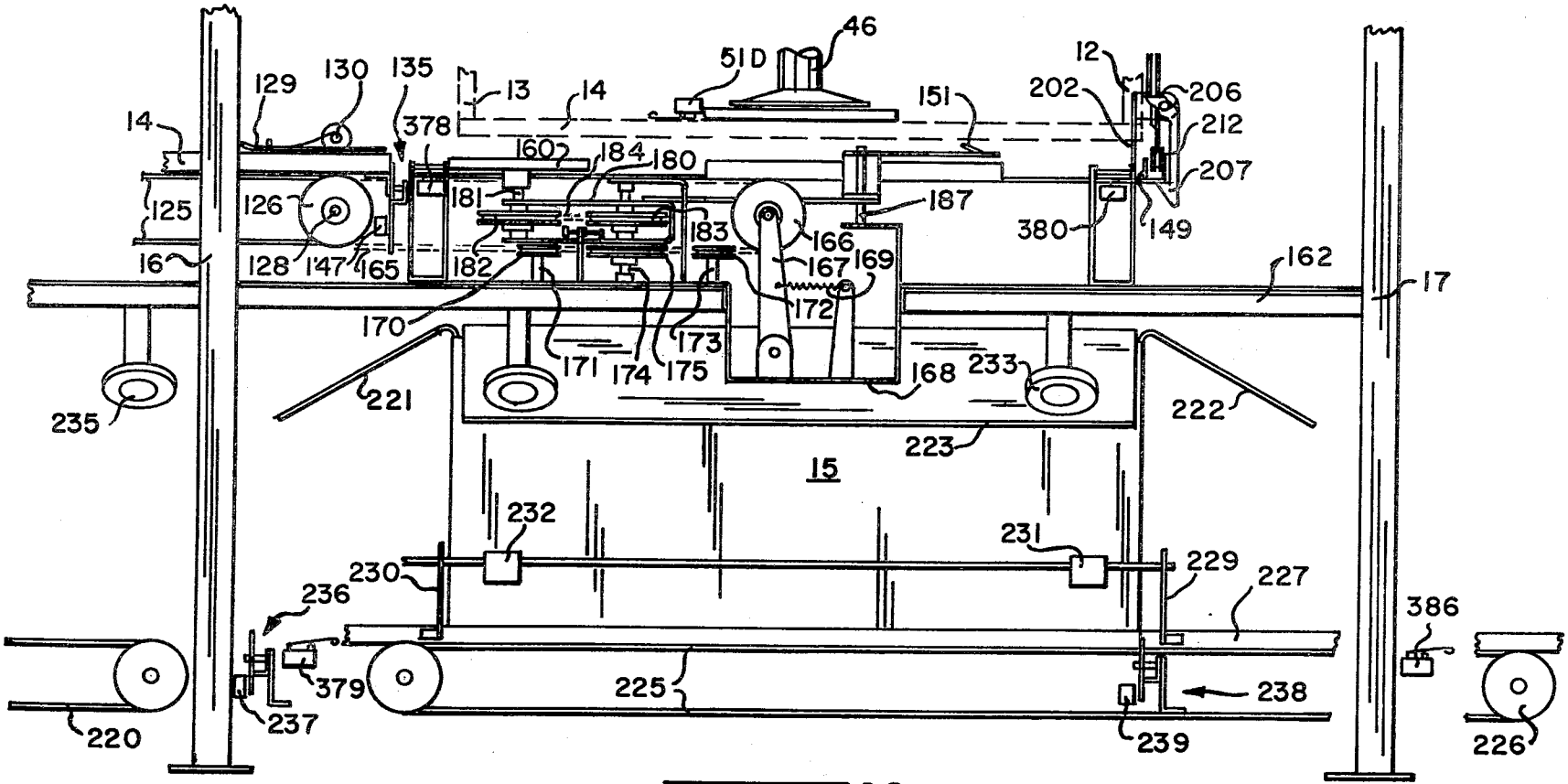
FIG. 12 is a side view of the mechanism shown in FIG. 11.

As indicated in FIGS. 3 and 12, bottom panels are loaded seriatim in flat horizontal array upon the distal end of an endless belt conveyor 125 passing over a driven pulley 126 and an idler pulley 127. The drive pulley is affixed to an elongated shaft 128 (FIG. 11) mounted at its ends on the stationary framework and driven by any suitable means (not shown). Also affixed to the framework is a spring means 129 carrying a roller 130 adapted to contact the upper surface of the incoming panel 14 and to hold it in proper position for insertion upon a pair of spaced downwardly pivotable shelves 131, 132 (FIG. 13) mounted upon the framework. These shelves serve to support the bottom panel prior to its engagement by the above-described panel-grasping mechanism.

Figure 13:
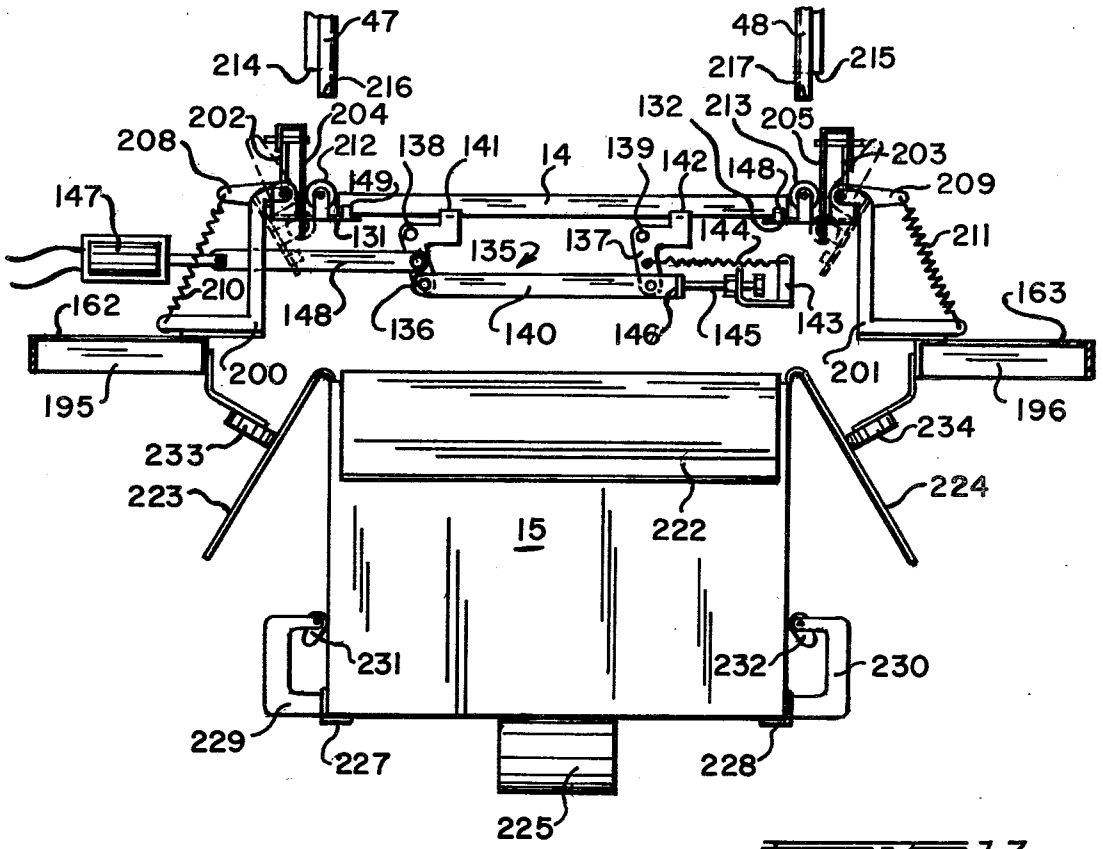
FIG. 13 is an end view, with portions omitted, of the bottom panel releasing mechanism in relation to the container to be lined.

Referring now to FIG. 12, a dispensing shutter means indicated generally at 135 and which governs advancement of the bottom panel to the shelves is located adjacent shaft 128 outboard of the container to be lined and in a plane normal to the plane of translation of the bottom panel. As seen in FIG. 13, the shutter means includes a pair of bell cranks 136, 137 pivotally mounted upon the framework at 138, 139 and with their respective lower arms being connected with a rod 140. The upper arms of the bell cranks include flat abutments 141, 142 extending normally into the path of the oncoming panel 14. A standard 143 affixed to the framework anchors one end of a tension spring 144 attached at its other end to the lower arm of bell crank 137. An adjustable screw 145 mounted on the standard bears against an end surface 146 of rod 140 and serves to determine the height to which the abutments are interposed in the path of the panel. A solenoid 147 mounted on the framework has its plunger connected by rod 148 to the lower arm of bell crank 136 and when energized serves to retract the abutments and to permit insertion of the bottom panel onto the shelves 131 and 132. Upon deenergization of solenoid 147 after a prescribed period governed by the switch and circuit breaking control later to be described, the bias of spring 144 serves to raise abutments 141, 142 and to obstruct passage of the next following bottom panel. Upon being carried forward under the impetus of the moving conveyor 125 the forward end of the bottom panel is arrested by rigid stops 148, 149 on the upper surface of the respective shelves and in passing to this indexed position moves under the vanes 150, 151 (FIG. 11) which serves to hold the bottom panel against upward movement prior to its engagement by the panel-grasping mechanism.

A switch 378 mounted uupon shelf 132 is actuated when the bottom panel travels a suitable distance, for example about one inch, from conveyor 125 and a similar switch 380 also mounted on that shelf is actuated when the bottom panel reaches the stops 148, 149.

As will be apparent, it is necessary to position the bottom panel rapidly in place upon the shelves in order to establish a gap in advance of the next following bottom panel on conveyor 125 and to enable the described dispensing shutter 135 to raise its latch faces 141 and 142 in obstructing relation to that following panel through such a gap. As seen in FIGS. 11 and 12, as soon as a bottom panel is impelled upon the shelves by conveyor 125 its side edges are contacted by relatively large, rapidly rotating side pulleys 160, 161 supported in housings which are rigidly mounted upon rails 162, 163 of the framework, and located laterally outboard of the path of movement of the container. Since the drive and control means for each of these side pulleys are identical, a description only of the pulley 160 is made herein.

From a pulley 164 on drive shaft 128 an endless belt 165 drives an idler pulley 166 mounted on a pivotal arm 167 supported on a housing 168 and biased with a tension spring 169 to take up slack. The lower reach of belt 165 engages an idler pulley 170 rotatable on a fixed shaft 171 supported on the housing and a second idler pulley 172 rotatable on a second fixed shaft 175 supported on the housing adjacent the pulley 166. Moreover, a rotatable shaft 174 journalled at its ends upon the housing has a drive pulley 175 attached thereto and is rotated as the belt in contact with pulley 175 moves from the idler pulley 172 to the idler pulley 170. A U-shaped bell crank 180 is pivotally mounted on rotatable shaft 174 and at the distal end of one arm a rotatable shaft 181 is mounted. To the upper end of this shaft the large side pulley 160 is keyed and between the upper and lower faces of the bell crank a pulley 182 is also keyed to shaft 181. In addition, a pulley 183 is keyed to shaft 174 between the same faces of the bell crank arm and by means of an endless belt 184 serves to drive pulley 182 and its attached shaft 181. Accordingly, when conveyor shaft 128 is rotated to advance a bottom panel beyond the retracted shutter 135 the described pulleys and belts serve to rotate pulley 160 in engagement with the side edge of that panel, and since the ratios of the several pulleys are chosen to provide a rapid translation forwardly of that panel, a gap is quickly provided between the panel and the next following panel.

To prevent bouncing of the panel on the shelves and to hold it in registered position the vane 151 is interposed above the panel and inwardly of the edge of shelf 131 and is attached to one arm 186 of a bell crank pivoted upon a rod 187 affixed to housing 168. The second arm 188 of this bell crank is connected by a link 189 to an arm 190 of the U-shaped bell crank. From the opposite side of the U-shaped bell crank another arm 191 extends and is biased by means of a tension spring 192 into the position shown in FIG. 11. A solenoid 193 has its plunger connected by a wire 194 with the arm 191 of the U-shaped bell crank and when energized serves to rotate that bell crank upon shaft 174 whereupon the vane 151 and the side pulley 160 are retracted laterally from contact with the bottom panel and permit that panel to be lifted by the panel-grasping mechanism. After the lining is completed the solenoid 193 is deenergized and spring 192 restores the equipment in readiness for the next bottom panel. As will be understood, the vane 150 and side pulley 161 associated with shelf 132 operate simultaneously with the above-described vane and side pulley and are under the influence of a similar solenoid 194.

The respective shelves are pivotally mounted on suitable supports 195, 196, 197 and 198 and when pivoted fully downward, as indicated in dotted lines in FIG. 13, will clear the space above the container for movement of the panel-grasping mechanism carrying the grasped lining panels. At one end of each shelf upstanding L-shaped brackets 200 and 201 are provided with an ear through which a pivot pin serves to support the shelf. Upstanding from these ears are plates 202, 203 journalling pins on which latches 204, 205 are pivotally mounted. As best seen in FIG. 12, each latch has an upper cam face 206 adapted to be moved by the respective latch-tripping legs 47, 48 of the panel-grasping mechanism, and a lower shelf-holding cam face 207 which swings beneath the shelf after such shelf is raised. The shelves are provided with bell crank arms 208, 209 to which are attached tension springs 210, 211 serving to hold the shelves normally in horizontal position, as seen in FIG. 11, and in addition have rollers 212, 213 on the upper surface of the shelves and disposed in the path of movement of the latch-tripping legs.

Refering now to FIGS. 5 and 13, the legs 47, 48 have lower edges 214, 215 which engage the cam faces 206 of the latches and downwardly offset edges 216, 217 which later engage the rollers 212, 213 as the panel-grasping mechanism moves downwardly, and after the latches have been swung from their latch positions.

CONTAINER SUPPLYING AND REMOVING MEANS

Beneath the bottom panel supplying conveyor 125 (FIG. 3) a conveyor 220 is provided and on which an array of open top containers 15 are placed with their respective top flaps 221, 222, 223, 224 bent downwardly. A separate conveyor 225 FIG. 12 and 13 operated at a much greater speed than conveyor 220 is located beneath the main framework and is driven by pulley 226 at its distant take-off end. Rails 227, 228 serve to guide the container while it is in contact with conveyor 225. Sets of Brackets 229, 230 supported from these rails serve to mount snubbing cams 231, 232 in contact with the sides of the container and which cams resist any tendency of the container to rise as the panel-grasping means moves upwardly after the container is lined. Guide rollers such as seen at 233, 234 and 235 supported on the framework serve to hold the side top flaps of the container in proper position as the container moves along the conveyors.

Intermediate the conveyors 220 and 225 a dispensing shutter means indicated generally at 236 and having a solenoid 237 is interposed. Also, at a position corresponding to the container being directly below the panel-grasping mechanism another shutter means indicated generally at 238 and having a solenoid 239 is located. These two shutter means preferably are of the same construction and operation as the bottom panel dispensing shutter 135 above described. Moreover, a switch 379 adapted to be closed as an empty container moves to conveyor 225 and a switch 386 adapted to be closed as a lined container leaves the lining station, are provided.

MECHANICAL AND ELECTRICAL CONTROL SYSTEM

Figures 14, 17:
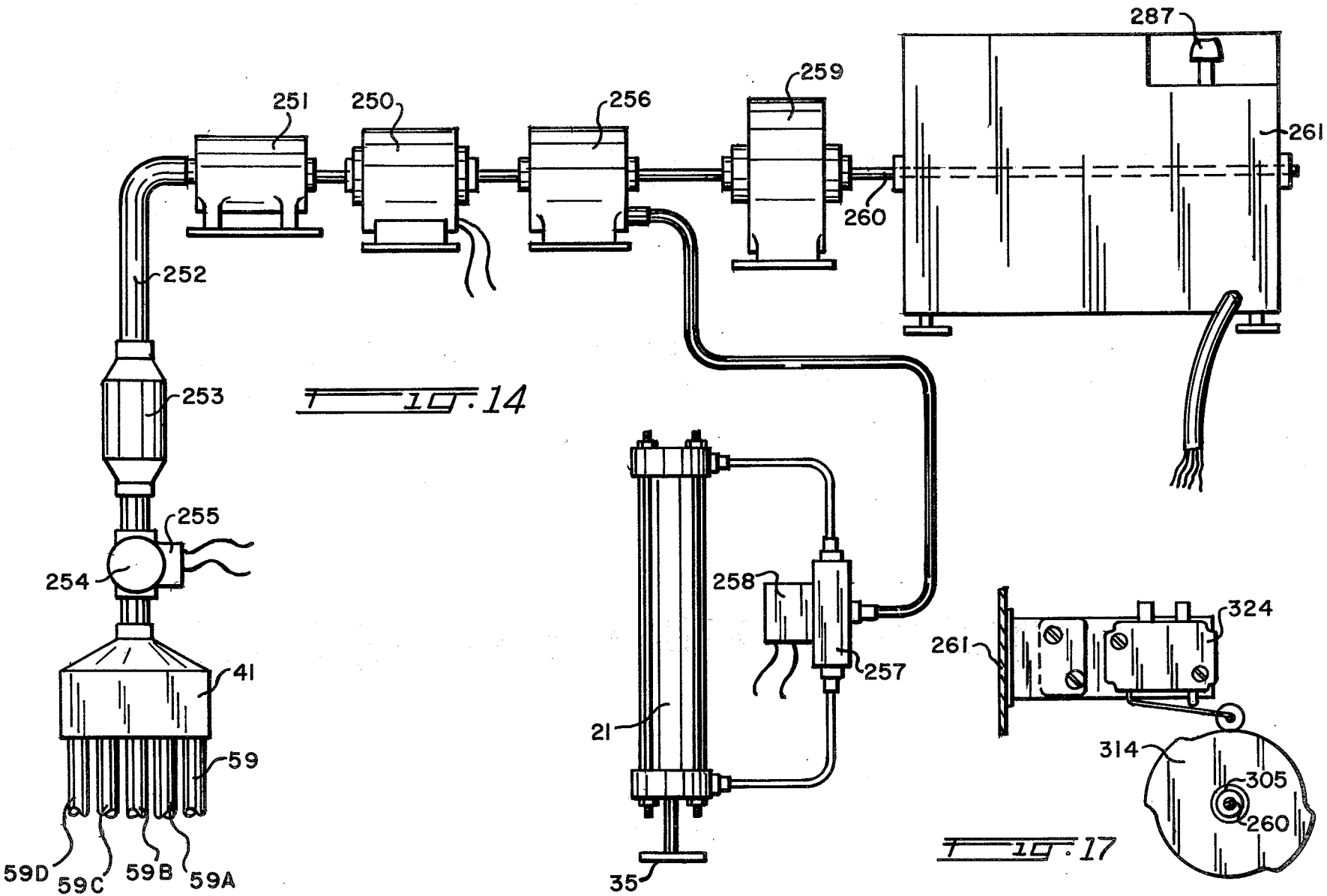
FIG. 14 is a view indicating a preferred arrangement of equipment for controlling the mechanical movements of the apparatus in timed sequence.
FIG. 17 is a view of one of the cam-operated switches taken on line 17—17 of FIG. 15.

Referring now to FIG. 14 an electrical motor 250 drives a vacuum pump 251 having a conduit 252 leading to the plenum chamber 41 from which flexible conduits 59, 59A, 59B, 59C and 59D lead to the respective tubes of the panel-grasping units. Interposed in conduit 252 is a suitable filter 253 for removal of extraneous material sucked through the conduits. A valve 254 in conduit 252 and controlled by solenoid 255 serves to apply and to interrupt the suction at appropriate times. Also driven by the motor 250 is an air compressor 256 connected to the double-acting air motor 21 for elevating and lowering the panel-grasping mechanism. A valve 257 controlled by solenoid 258 governs the application of the air pressure to motor 21. A gear reducer 259 driven by motor 250 has a take-off shaft 260 journalled in a suitably ventilated control box housing 261, now to be described, and which shaft preferably rotates at about 24 rpm corresponding to a rapid and automatic lining cycle of about 2.5 seconds per container.

As best shown in FIG. 15 to 18, the shaft 260 is journalled for rotation within the housing 261 and rotates so long as motor 250 is energized. Rigidly attached to the shaft is an arbor 262 having pins 263, 264 extending through holes in a reset plate 265 which is freely mounted on shaft 260 and is biased for axial movement on the shaft by a light compression spring 266. Retracting movement of plate 265 while it is rotating is transmitted to a roller 267 supported on one arm 268 of a bell crank pivotally supported on a pin 269 mounted on a bracket 270 within the housing. The other arm 271 of the bell crank is biased by a light tension spring 272 and carries a switch-actuating roller 273 adapted to actuate switch 274 which in turn governs the actuation of solenoid 275 of the reset interlock.

A yoke member 280 mounted on one side of the housing (FIG. 18) under the bias of a torsion spring (not shown) has an upper arm 281 carrying a roller 282 and a lower arm 283 carrying a roller 284 bearing at all times upon the reset plate 265. Disposed above the upper roller is a latch arm 284 pivotally mounted upon a bracket 285 suspended from the housing and biased toward latching position by a spring 286. A manually operable reset button 287 engages the latch arm. As will be understood, when reset plane 265 is urged toward arbor 262 as a result of a malfunction of the above-described mechanical operations of the apparatus, the latch arm engages behind yoke arm 281 and holds the reset plate, while it is still rotating, in a retracted position against the bias of spring 266 and in the manner now to be described.

Figure 18:
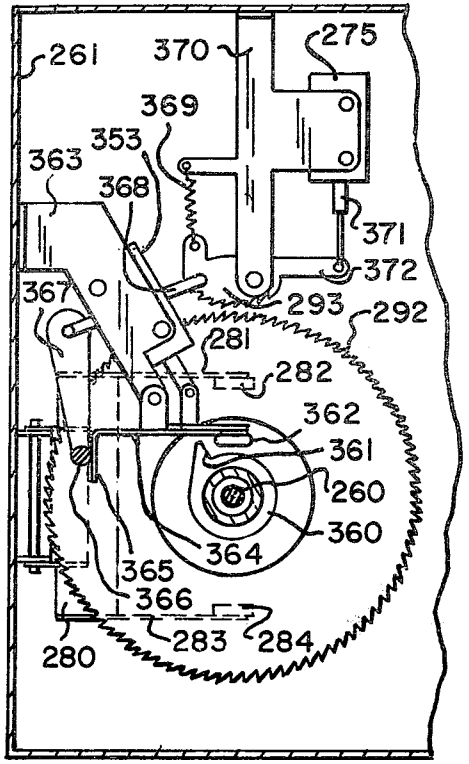
FIG. 18 is a view of one of the solenoid-operated latches taken on line 18—18 of FIG. 15.
Figure 16:
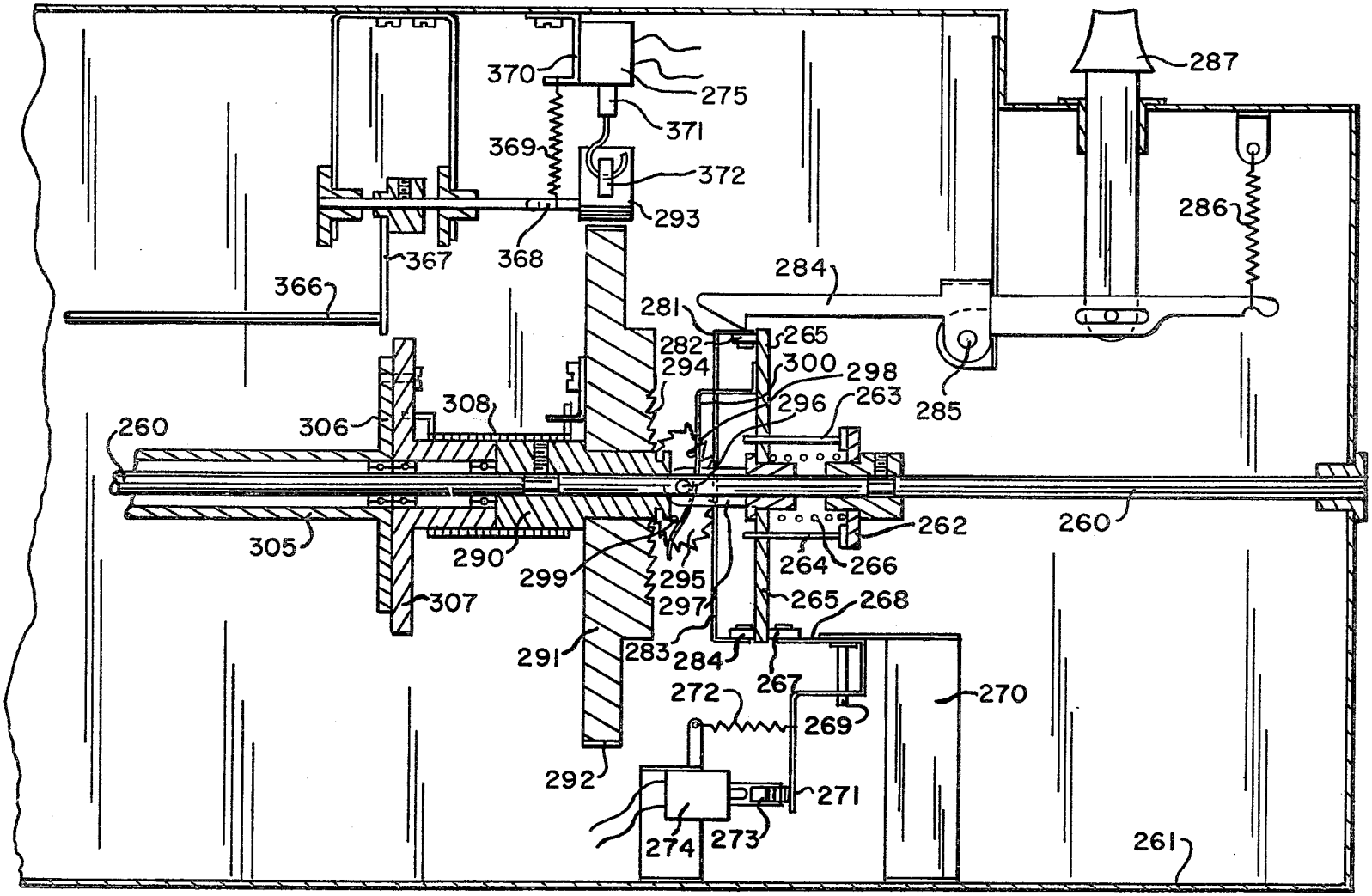
FIG. 16 is a sectional view to a larger scale of the remainder of the control box housing showing the drive from the control shaft and the safety-interlock mechanism.

As seen in FIGS. 16 and 18 an arbor 190 is attached to shaft 260 and a large clutch plate 291 is loosely mounted thereon. Significantly, the clutch plate is provided with teeth 292 about its periphery and which teeth are engaged by a pivotally mounted pawl 293 having suitable teeth engageable with the teeth of the clutch plate. The clutch plate has an annular row of teeth 294 provided on its surface facing the reset plate 265 and a pair of spaced double-ended elliptical cams (one being shown at 295) are pivotally mounted as at 296 upon arms 297 projecting from reset plate 265 toward clutch plate 291. These cams have teeth engageable with the annular row of teeth 294 and when a malfunction occurs which serves to stop rotation of the clutch plate, the continued rotation of the reset plate causes the cams to rotate eccentrically about their pivot point 296 and to bring locator pins 298 and 299 projecting laterally from those cams into contact with a leaf spring 300 which is mounted upon the still rotating reset plane. This action then results in the reset plate being pushed axially against the bias of spring 266 and in the switch 274 being actuated and the latch 284 becoming engaged and also in the cams being removed from contact with plate 291. Later when the reset button 287 has been pushed the latch 284 disengages and spring 266 moves the reset plate to normal position and the cams 295 again mesh with teeth 294.

Figure 15:
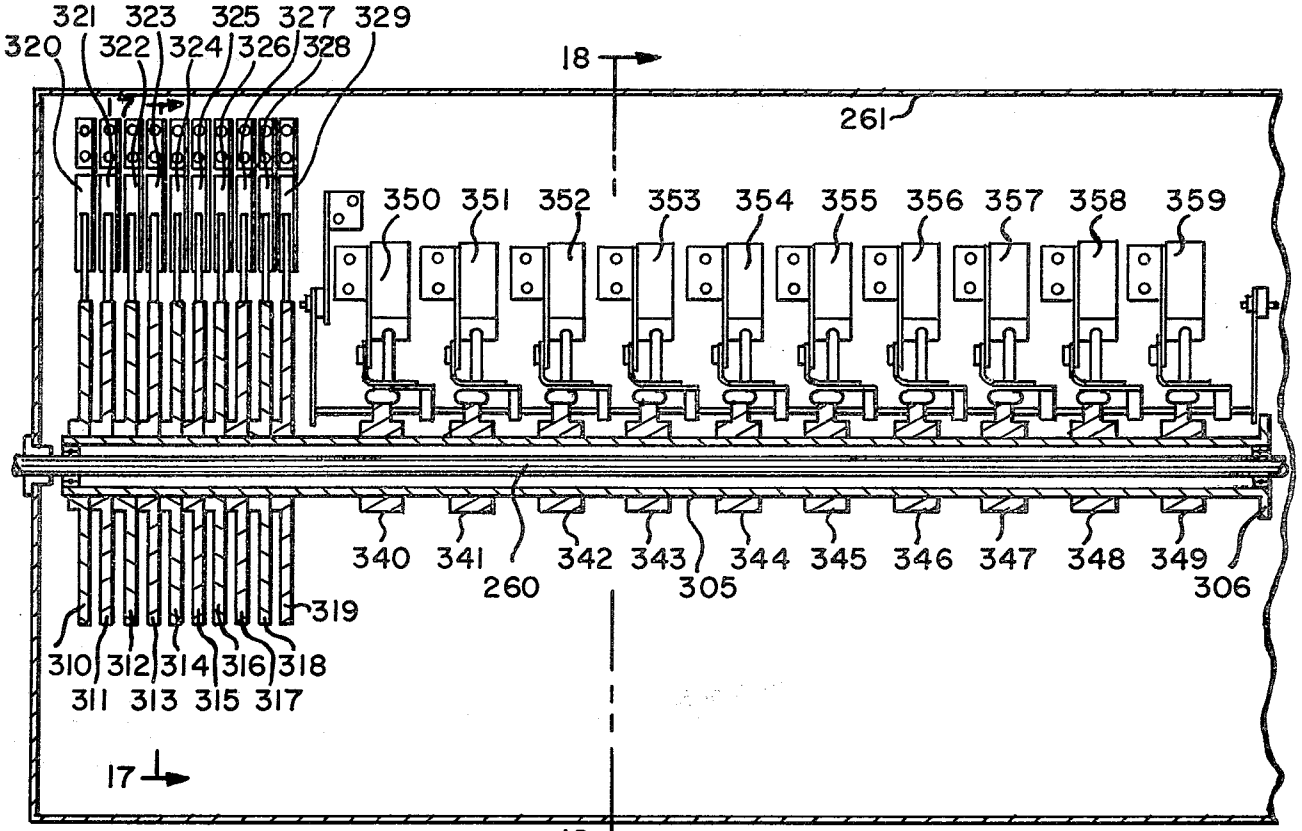
FIG. 15 is a sectional view of the portion of the control box housing which encloses cam-operated switches and solenoid-operated latches.

Referring now to FIG. 15, an elongated tube 305, whose rotation is dependent upon prescribed sequential events occuring in the operation of the described lining apparatus, is journalled upon shaft 260 and has a flange 306 attached to a spring clutch plate 307. A spring clutch 308 anchored at one end upon plate 307 and at the other end upon the large clutch plate 291 surrounds the rotating arbor 290 and the arbor of plate 307. Adjacent one end the tube has attached thereto a series of ten suitably circumferentially spaced cams 310, 311, 312, 313, 314, 315, 316, 317, 318 and 319 adapted to actuate respectively the switch 320 associated with the solenoid 147 of the bottom line shutter; the switch 321 associated with the solenoid 239 of the ready carton stop; the switch 322 associated with the solenoid 237 of the next following carton stop; the switch 323 associated with the dual pulse solenoids 333 and 335 for the pair of side liner panels; the switch 324 associated with the dual pulse solenoids 76 and 334 for the pair of end liner panels; the switch 325 for the dual pulse solenoid 336 for the single bottom panel, the switch 326 for the series connected solenoids 193 and 194 of the bottom panel pivotal drive (FIG. 11); the switch 327 for the solenoid 255 of the vacuum control valve 254 (FIG. 14); the switch 328 for the series connected solenoids 104, 104A, 104B and 104C of the respective liners (FIG. 8); and the switch 329 for the solenoid 258 of the air cylinder control (FIG. 14).

As seen in FIG. 17, the cams delivering dual pulses to its switch are provided with dual can lobes adapted to actuate the followers of a micro switch mounted upon the housing 261 whereas the other cams requiring only a single energization of a solenoid have a single lobe.

Significantly, the invention provides for the immediate arresting of rotation of tube 305 and of the cams 310 to 319 in the event of a malfunction occuring in the prescribed lining process, and for the resumption of such rotation beginning at the point at which such interruption occurred. A series of ten similar latches 340, 341, 342, 343, 344, 345, 346, 347, 348 and 349 (one of which is best shown in FIG. 18) are keyed to tube 305 in suitably circumferentially spaced relation and are moved to a latching position under the control of their respective solenoids 350 to 359 when such solenoids are actuated by the several sensing switches associated with mechanical movements occurring in the lining apparatus. The latch comprises a disc 360 having an abutment 361 in whose orbit a roller 362 is adapted to be left in the path of the latch when a malfunction occurs and to be raised when that malfunction is corrected. A bracket 363 attached to casing 261 pivotally mounts a lever 364 carrying roller 362 at one end and having a bail-engaging portion 365 at its other end. The plunger rod of solenoid 353 is pivotally attached to the lever with the result that when the roller is left in position to obstruct rotation of disc 360 the bail 366 is moved.

As shown in FIG. 16, the bail 366 is attached at one end to a bell crank arm 367 with the other crank arm 368 being pivotally attached to pawl 293. This pawl is normally lifted from engagement with the teeth 292 of clutch plate 291 by tension spring 369 attached to bracket 370. The bracket also supports solenoid 275 having its plunger rod 371 connected to arm 372 of the pawl. When, therefore, the bail is pivoted by any one of the latches obstructing rotation of tube 305 the pawl becomes engaged with clutch plate 291 and the spring clutch 308 is unwound with both the plate 307 and the plate 291 coming to rest. At this time the above-described elliptical cams 295 revolve to force the reset plate 265 out of engagement with the clutch plate and the solenoid 275 is energized to keep the pawl 293 lifted until the malfunction is corrected and the reset button has been pushed.

OPERATION

Assuming the apparatus to be in readiness for starting, the operator first closes power switch 375 (FIG. 19) starting motor 250 and through transformer 376 furnishing power at low voltage to the circuits in housing 261. The master control switch 377 is normally closed with the result that latch solenoid 359 is energized holding its lever away from the abutment of latch 349 on tube 305. The operator than pushes the reset button 287 to clear the interlocks thus placing the system in its operation mode. As the tube 305 rotates and cam 310 effects the resulting entry of the bottom liner on to the shelves 131, 132 the switch 378 is closed (for example at about 50 milliseconds (ms) of operation) and this results in the energization of solenoid 358 and the holding of its lever away from the abutment of latch 348 on tube 305.

Further rotation of the tube and cam 312 effects the resulting entry of the empty carton onto conveyor 225. When switch 379 has been closed by the carton passing over it (for example at about 150 ms of opeation) this results in the energization of solenoid 357 and the holding of its lever away from the abutment of latch 347 on tube 305. As the tube continues to rotate and switch 380 is closed by the bottom liner reaching proper position on the shelves (at about 450 ms) causing energization of solenoid 356 and the holding of its lever away from the abutment of latch 346 on tube 305.

Additional rotation of tube 305 with concurrent closing of the microswitches 51B and 51C of the side panel-grasping units indicate that the side panels are grasped, and effect the energization of solenoids 354 and 353 simultaneously and hold their levers away from the abutments of latches 343 and 344 on tube 305. Preferably this action occurs at about 600 ms of operation. Thereafter additional rotation of tube 305 with concurrent closing of microswitches 51 and 51A of the end panel-graspers indicate that the end panels are grasped, and effect the energization of solenoids 352 and 351 simultaneously and hold their levers away from the abutments of latches 341 and 342 on tube 305. Pereferably this action occurs at about 650 ms of operation.

With tube 305 continuing to rotate and with concurrent closing of microswitch 51D indicating that the bottom panel is grasped, the energization of solenoid 350 is effected and its lever is held away from the abutment of latch 340 on tube 305. Preferably this action occurs at about 2450 ms of operation.

As will be apparent, the above-described normal operation is conducted automatically in accordance with a prescribed program of interrelated steps involving the coordinated action of sensing switches, the making and breaking of circuits by the ten rotating cams on tube 305 and the sequential energization of the solenoids associated with the ten latches on that tube. However, should a malfunction occur involving the failure of any of the sensing switches to operate, the appropriate lever witll engage is latch abutment and through the rotation of the bail 366, the pawl 293 will engage and stop the rotation of the clutch plate 291. This will cause the spring clutch 308 to unwind enough to disengage the spring clutch plate 307 which is the only driving means of tube 305 through the flange 306, thereby stopping the rotation of tube 305.

Since the reset plate 265 containing the elliptical cams 295 is continuously rotating, the engagement of the teeth on the rotating cams against the now motionless teeth 294 of the clutch plate 291 causes the cams to drive the reset plate 265 toward the arbor 262 against the bias of compression spring 266. When in the fully retracted position, the reset plate has travelled far enough to allow the latch 284 to engage the surface 281 of the yoke 280. As previously described the switch 274 (FIG. 16) energized the solenoid 275 as the reset plate is moved. This will insure that the pawl 293 will not become disengaged from the clutch plate 291 until the reset button 287 is pushed. Upon movement of switch 274 the circuit through a conventional counter 390, serving to count the number of containers being filled, is broken.

Significantly, the circuit arrangement is such that the operator may safely work on any portion of the apparatus in correcting a malfunction and with assurance that until reset button 287 is pushed further movements of the apparatus on which he is working will remain at rest. Moreover, no adjustment of the control system to a prescribed starting cycle is required since when button 287 is pushed the interrupted cycle begins at the point at which it was interrupted.

In recapitulation and with reference to FIGS. 4, 5, 6, 7, 11, 12 and 17, with the several conveyors supplying panels and containers the bottom panel 14 is moved to its loaded position on the shelves (FIG. 11); the container 15 is moved to the loading station beneath the panel-grasping mechanism (FIG. 12); the vacuum control valve 254 (FIG. 17) is opened to supply vacuum to each of the extended tubular sleeves 60 (FIG. 7) of the five grasper units and which are then latched against the vacuum pull on the engaged panel; the five grasper units are relatched in a tighter configuration holding the five panels in a box-like arrray; the valve 257 (FIG. 17) is moved to a position inducing downward movement of the panel-grasping mechanism; the array is moved into the container and the five grasper units are again moved into a still tighter configuration; the empty panel-grasping mechanism is lifted to its uppermost position above the lined container (FIG. 4) and the lined container is propelled from conveyor 225 (FIG. 12) meanwhile actuating the sensing switch 386 and with the next following empty container entering conveyor 225 and actuating the sensed switch 379.

Having thus described a preferred form of apparatus for rapidly lining containers and a method for opearating the same automatically in accordance with a prescribed program of interrelated steps, it will be understood that the invention may also be embodied in forms other than that exemplified as the preferred form and that such changes and modifications may be made within the scope of the appended claims.

What is claimed is:

1. A method of automatically lining an open-top container comprising, moving an empty unlined container to a lining station below a panel-grasping mechanism and thereafter moving the lined continer from said station, horizontally moving a flat bottom liner panel to said station, dispensing side and end lining panels from four separate storage racks extending horizontally from said station, grasping each of two end panels, two side panels and one bottom panel with said panel-grasping mechanism, bringing said panels into contact with each other in the form of an open-top, box-like array above said container, moving said array downwardly into said container, releasing the panel-grasping mechanism from said array, thereafter moving the released mechanism upwardly from the lined container, and automatically conducting the above-recited steps of operation in accordance with a preferred program of interrelated steps.

2. The method of claim 1 including applying a vacuum holding upon said panels following the grasping of the panels by said grasping mechanism.

3. The method of claim 2 including mechanically impaling said panels and holding the same against shifting as they are brought into contact with each other and as they are moved into said container.

4. The method of claim 3 wherein said impaling step preceeds said application of vacuum.

5. The method of claim 1 comprising a rapid lining operation and including moving the empty container to a ready position adjacent said lining station at a first speed and from said ready position to said lining station at a second and greater speed thereby to increase the rate of lining of said containers.

6. The method of claim 1 comprising a rapid lining operation and including, moving the bottom panel to a ready position adjacent the lining station at a first speed and from said ready position to said lining station at a second and greater speed thereby to increase the rate of lining of said containers.

7. A method of automatically and safely lining an open top container including, moving an unlined container to a lining station below a panel-grasping mechanism and thereafter moving the lined container from said station, horizontally moving a flat bottom liner to said station, dispensing side and ends liners from four separate storage racks extending horizontally from said station, grasping each of two side panels, two end panels and one bottom panel with said panel-grasping mechanism, bringing said panels into contact with each other in the form of an open-top box-like array above said container, moving the array downwardly into said container, releasing the panel-grasping mechanism from said array, thereafter moving the released mechanism upwardly from the lined container, automatically conducting the above-recited steps of operation in accordance with a prescribed program of interrelated steps, automatically interrupting the operation when a malfunction causes a deviation from said program, manually correcting the malfunction, and thereafter manually restarting the operation from the stage of the program at which the malfunction occurred.

8. The method of claim 7 wherein said interruption comprises the declutching of a constantly rotating drive shaft from a rotatable member governing sequence of program operations and the restarting of operation comprises the reclutching of said constantly rotating shaft to said member.

9. Apparatus for automatically lining an open-top container comprising, a framework defining a lining station, four racks extending generally horizontally from said framework and adapted to supply side and end lining panels, a bottom-panel conveyor extending generally horizontally from said framework and adapted to supply bottom lining panals, pivotal support means at said lining station receiving bottom panels from said bottom-panel conveyor, a lined-container take-off conveyor at said lining station, an empty container supply conveyor for feeding containers to said take-off conveyor, a generally vertically movable panel-grasping mechanism at said lining station, means for moving said pivotal support means out of the path of the descending panel-grasping mechanism, said mechanism comprising five grasper units respectively engageable with two side panels, two end panels an one bottom panel and serving to construct therefrom and to hold an array of lining panels in the form of an open-top box, means for moving said array while grasped by said mechanism into an empty container resting upon said take-off conveyor, means for releasing the hold of said grasper units from said array, means for returning said mechanism to its upper position in readiness for a subsequent lining cycle, and control means for operating the apparatus in accordance with a prescribed program of interrelated steps of operation.

10. Apparatus as defined in claim 9 wherein said means for moving said mechanism upwardly and downwardly comprises a double-acting motor actuated by said control means.

11. Apparatus as defined in claim 9 wherein said take-off conveyor is driven at a greater speed than said empty-container supply conveyor.

12. Apparatus as defined in claim 9 including means for propelling said bottom panel to said pivotal support means at a greater speed than the speed of said bottom panel conveyor.

13. Apparatus as defined in claim 9 including panel dispensing means at the ends of said racks at said lining station, said dispensing means being actuated by said control means and serving to restrain the next following panel as the leading panel is engaged by the grasper units.

14. Apparatus as defined in claim 9 including means for holding said bottom panel stationary on said shelves prior to its being grasped by the corresponding grasper units of said mechanism.

15. For use in the lining of an open-top container, a liner-panel-grasping mechanism including separate grasping units for each of two side panels, two end panels and a bottom panel; each of said units being supported on a vertically movable member an comprising a tube secured on said member, a sleeve reciprocable on said tube and having a panel-engaging face at its distal end, a spring normally urging said face outwardly toward the panel, a source of vacuum connected to said tube and adapted to move said sleeve and the panel engaged therewith inwardly against the bias of said spring; latching means cooperating with said sleeve and adapted to hold said sleeve successively in a fully extended position in engagement with the panel, in a retracted position in engagement with the panel and in a latch-free final position disengaged from said panel; a solenoid for operating said latching means, and a control means for connecting and disconnecting said vacuum source and said tube, for energizing and deenergizing said solenoid, and for raising and lowering said movable member.

16. A liner-panel-grasping mechanism as defined in claim 15 including a sensing switch forming part of said control means and mounted on said vertically movable member, said switch being positioned for actuation by the panel when said sleeve moves inwardly against the bias of said spring.

17. A liner-panel-grasping mechanism as defined in claim 15 including pivotal vanes supported on said mechanism and serving to hold said two side panels and said two end panels in planes normal to the plane of the bottom panel.

18. A liner-panel-grasping mechanism as defined in claim 15 including impaling means projecting from the faces of said sleeves and adapted to hold the engaged panel against shifting within the plane in which it is first engaged by said impaling means.

19. A liner-panel-grasping mechanism as defined in claim 15 including a vacuum plenum casing movable with said vertically movable member and having conduits connected to the respective tubes of each of said grasping units.

20. A liner-panel-grasping mechanism as defined in claim 15 including a double-acting compressed air motor having its movable portion connected to said vertically movable member.

* * * * *